US010739708B2

(12) United States Patent
Suzuki

(10) Patent No.: US 10,739,708 B2
(45) Date of Patent: Aug. 11, 2020

(54) GUIDE AND END GUIDE PROVIDED IN FIXING DEVICE, AND METHODS OF MANUFACTURING GUIDE AND END GUIDE

(71) Applicant: BROTHER KOGYO KABUSHIKI KAISHA, Nagoya-shi, Aichi-ken (JP)

(72) Inventor: Kaoru Suzuki, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/158,445

(22) Filed: Oct. 12, 2018

(65) Prior Publication Data

US 2019/0041778 A1 Feb. 7, 2019

Related U.S. Application Data

(62) Division of application No. 15/439,216, filed on Feb. 22, 2017, now Pat. No. 10,101,692.

(30) Foreign Application Priority Data

Feb. 29, 2016 (JP) ..... 2016-036904

(51) Int. Cl.
*G03G 15/20* (2006.01)
*G03G 21/16* (2006.01)
*G03G 15/00* (2006.01)

(52) U.S. Cl.
CPC ..... *G03G 15/2028* (2013.01); *G03G 15/2017* (2013.01); *G03G 15/2053* (2013.01);
(Continued)

(58) Field of Classification Search
CPC ..... G03G 15/2017; G03G 15/2028; G03G 15/2053; G03G 15/2057; G03G 15/2085;
(Continued)

(56) References Cited

U.S. PATENT DOCUMENTS 9,020,407 B2 * 4/2015 Hashimoto ..... G03G 15/2017 399/122
2002/0175795 A1 11/2002 Fuseya
(Continued)

FOREIGN PATENT DOCUMENTS

JP 2006-259039 A 9/2006
JP 2009-251253 A 10/2009
(Continued)

OTHER PUBLICATIONS

Office Action issued in corresponding Chinese Patent Application No. 201710104284.2, dated Nov. 29, 2019.

*Primary Examiner* — Joseph S Wong
(74) *Attorney, Agent, or Firm* — Merchant & Gould P.C.

(57) ABSTRACT

There is provided a guide incorporated in a fixing device including a belt configured to circularly move in a moving direction. The guide includes: a guide portion elongated in a longitudinal direction orthogonal to the moving direction; a first gate mark; and a second gate mark arranged spaced apart from the first gate mark in the longitudinal direction. The guide portion includes a resin and a plurality of elongated-shaped fillers dispersed in the resin. The guide portion has a guide surface configured to guide movement of the belt in the moving direction, a peripheral surface of the belt being configured to contact the guide surface.

15 Claims, 12 Drawing Sheets

(52) U.S. Cl.
CPC ..... *G03G 15/2057* (2013.01); *G03G 15/657* (2013.01); *G03G 15/6573* (2013.01); *G03G 21/1685* (2013.01); *G03G 2215/2003* (2013.01); *G03G 2215/2035* (2013.01); *G03G 2215/2038* (2013.01); *G03G 2221/1639* (2013.01)

(58) Field of Classification Search
CPC ..... G03G 15/657; G03G 15/6573; G03G 21/1685; G03G 2215/2003; G03G 2215/2035; G03G 2215/2038; G03G 2221/1639; B29C 45/00
See application file for complete search history.

(56) References Cited

U.S. PATENT DOCUMENTS

| | | | | |
|---|---|---|---|---|
| 2012/0243921 | A1* | 9/2012 | Fuchigami ..... | H05B 3/0066 399/329 |
| 2016/0018765 | A1 | 1/2016 | Tamura | |

FOREIGN PATENT DOCUMENTS

| | | | |
|---|---|---|---|
| JP | 2014-026027 | A | 2/2014 |
| JP | 2015-194564 | A | 11/2015 |

* cited by examiner

UP
DOWN
RIGHT
FRONT
REAR
LEFT
100
110
120
130
140(140A)
140(140B)
141
141(141R)
141(141C)
141(141L)
142
143
190
190(191)
190(192)
190(193)
200
210
211
212
213
220
221
L1
L21
L22

GUIDE MEMBER MANUFACTURING PROCESS

END GUIDE MANUFACTURING PROCESS

UP
DOWN
LEFT
RIGHT
100A
110
120
140
140(140A)
141
141(141C)
141(141L)
141(141R)
142
143
150
194
320A
A
X

GUIDE AND END GUIDE PROVIDED IN FIXING DEVICE, AND METHODS OF MANUFACTURING GUIDE AND END GUIDE

CROSS REFERENCE TO RELATED APPLICATION

This application is a divisional of U.S. patent application Ser. No. 15/439,216, filed Feb. 22, 2017, which further claims priority from Japanese Patent Application No. 2016-036904 filed Feb. 29, 2016. The entire content of the priority application is incorporated herein by reference.

TECHNICAL FIELD

The present disclosure relates to a method of manufacturing a guide member incorporated in a fixing device having an endless belt, a method of manufacturing end guide members incorporated in a fixing device having an endless belt, and a fixing device provided with an endless belt and a guide member.

BACKGROUND

Fixing devices for thermally fixing developer images that have been transferred onto a sheet of paper are well known in the art. One such fixing device includes an endless belt, and a guide member having a guiding surface configured to contact an inner peripheral surface of the belt for guiding the endless belt (for example, refer to Japanese Patent Application Publication No. 2015-194564).

SUMMARY

In order to improve strength and heat-resistance of the guide member, the guide member can be formed by a resin material compounded with elongated-shaped fillers, such as glass fibers. However, some of the fillers added to the resin material are exposed on the guiding surface of the guide member to protrude therefrom. When oriented in a width direction orthogonal to a moving direction of the endless belt, the exposed fillers may cause the inner peripheral surface of the endless belt to wear prematurely, reducing the durability of the endless belt.

In view of the foregoing, it is an object of the present disclosure to provide a method of manufacturing a guide member capable of improving durability of an endless belt, a method of manufacturing an end guide member, and a fixing device provided with the guide member and the end guide member.

In order to attain the above and other objects, the disclosure provides a guide that is incorporated in a fixing device including a belt configured to circularly move in a moving direction. The guide includes a guide portion, a first gate mark and a second gate mark. The guide portion is elongated in a longitudinal direction orthogonal to the moving direction. The guide portion includes a resin and a plurality of elongated-shaped fillers dispersed in the resin. The guide portion has a guide surface configured to guide movement of the belt in the moving direction, a peripheral surface of the belt being configured to contact the guide surface. The second gate mark is arranged at a position spaced apart from the first gate mark in the longitudinal direction.

According to another aspect, there is provided a guide that is incorporated in a fixing device including a belt configured to circularly move in a moving direction. The guide includes: a guide portion elongated in a longitudinal direction orthogonal to the moving direction; and a gate mark elongated in the longitudinal direction. The guide portion includes a resin and a plurality of elongated-shaped fillers dispersed in the resin. The guide portion has a guide surface configured to guide movement of the belt in the moving direction, a peripheral surface of the belt being configured to contact the guide surface.

According to still another aspect, there is provided an end guide that is incorporated in a fixing device including an endless belt configured to circularly move in a moving direction, the endless belt being elongated in a longitudinal direction orthogonal to the moving direction, the endless belt having an end portion in the longitudinal direction. The end guide includes a guide portion and an end gate mark. The guide portion has a length in the longitudinal direction that is shorter than a length of the endless belt in the longitudinal direction. The guide portion includes a resin and a plurality of elongated-shaped fillers dispersed in the resin. The portion includes a guide surface, a first surface, a second surface, and a third surface. The guide surface is configured to guide movement of the endless belt in the moving direction, an inner peripheral surface of the end portion of the endless belt being configured to contact the guide surface. The first surface is opposite the guide surface, the first surface having a center portion positioned center in the moving direction. The second surface is positioned at a downstream side relative to the guide surface in the moving direction, the second surface defining a downstream edge and facing downstream in the moving direction. The third surface is positioned at an upstream side relative to the guide surface in the moving direction, the third surface defining an upstream edge and facing upstream in the moving direction. The end gate mark protrudes from one of the center portion of the first surface, the second surface and the third surface.

According to still another aspect, there is provided a method of manufacturing a guide incorporated in a fixing device, the fixing device including a belt configured to circularly move in a moving direction, the guide including a guide portion extending in a longitudinal direction orthogonal to the moving direction, the guide portion having a guide surface configured to guide movement of the belt in the moving direction, a peripheral surface of the belt being configured to contact the guide surface. The method includes: preparing a mold, the mold having a cavity and a first gate and a second gate, the cavity having a shape in conformance with a shape of the guide portion, the first gate and the second gate being spaced apart from each other in the longitudinal direction; and injecting a resin containing a plurality of elongated-shaped fillers into the cavity through the plurality of gates to mold the guide portion.

According to still another aspect, there is provided a method of manufacturing a guide incorporated in a fixing device, the fixing device including a belt configured to circularly move in a moving direction, the guide including a guide portion extending in a longitudinal direction orthogonal to the moving direction, the guide portion having a guide surface configured to guide movement of the belt in the moving direction, a peripheral surface of the belt being configured to contact the guide surface. The method includes: preparing a mold having a cavity and a gate, the cavity having a shape in conformance with a shape of the guide portion, the gate having a shape elongated in the longitudinal direction; and injecting a resin containing a plurality of elongated-shaped fillers into the cavity through the gate.

According to still another aspect, there is provided a method of manufacturing an end guide incorporated in a fixing device, the fixing device including an endless belt configured to circularly move in a moving direction, the endless belt being elongated in a longitudinal direction orthogonal to the moving direction and having an end portion in the longitudinal direction, the end guide including a guide portion having a length in the longitudinal direction that is smaller than a length of the endless belt in the longitudinal direction, the guide portion including: a guide surface configured to guide movement of the endless belt in the moving direction, an inner peripheral surface of the end portion of the endless belt being configured to contact the guide surface; a first surface opposite the guide surface, the first surface having a center portion positioned center in the moving direction; a second surface positioned at a downstream side relative to the guide surface in the moving direction, the second surface defining a downstream edge and facing downstream in the moving direction; and a third surface positioned at an upstream side relative to the guide surface in the moving direction, the third surface defining an upstream edge and facing upstream in the moving direction. The method includes: preparing a mold having a cavity and a gate, the cavity having a shape in conformance with a shape of the guide portion; and injecting a resin containing a plurality of elongated-shaped fillers into the cavity through the gate. The mold includes: a first molding surface for molding the center portion of the first surface; a second molding surface for molding the second surface; and a third molding surface for molding the third surface. The gate is provided at one of the first molding surface, the second molding surface and the third molding surface.

DETAILED DESCRIPTION

1. First Embodiment

Hereinafter, a laser printer 1 provided with a fixing device 8 as a fixing device according to a first embodiment of the disclosure will be described with reference to FIGS. 1 through 7.

In the following description, the right side in FIG. 1 will be defined as a "front side"; the left side in FIG. 1 will be defined as a "rear side"; the near side in FIG. 1 will be referenced as a "left side"; and the far side in FIG. 1 will be referenced as a "right side."

Figure 1:
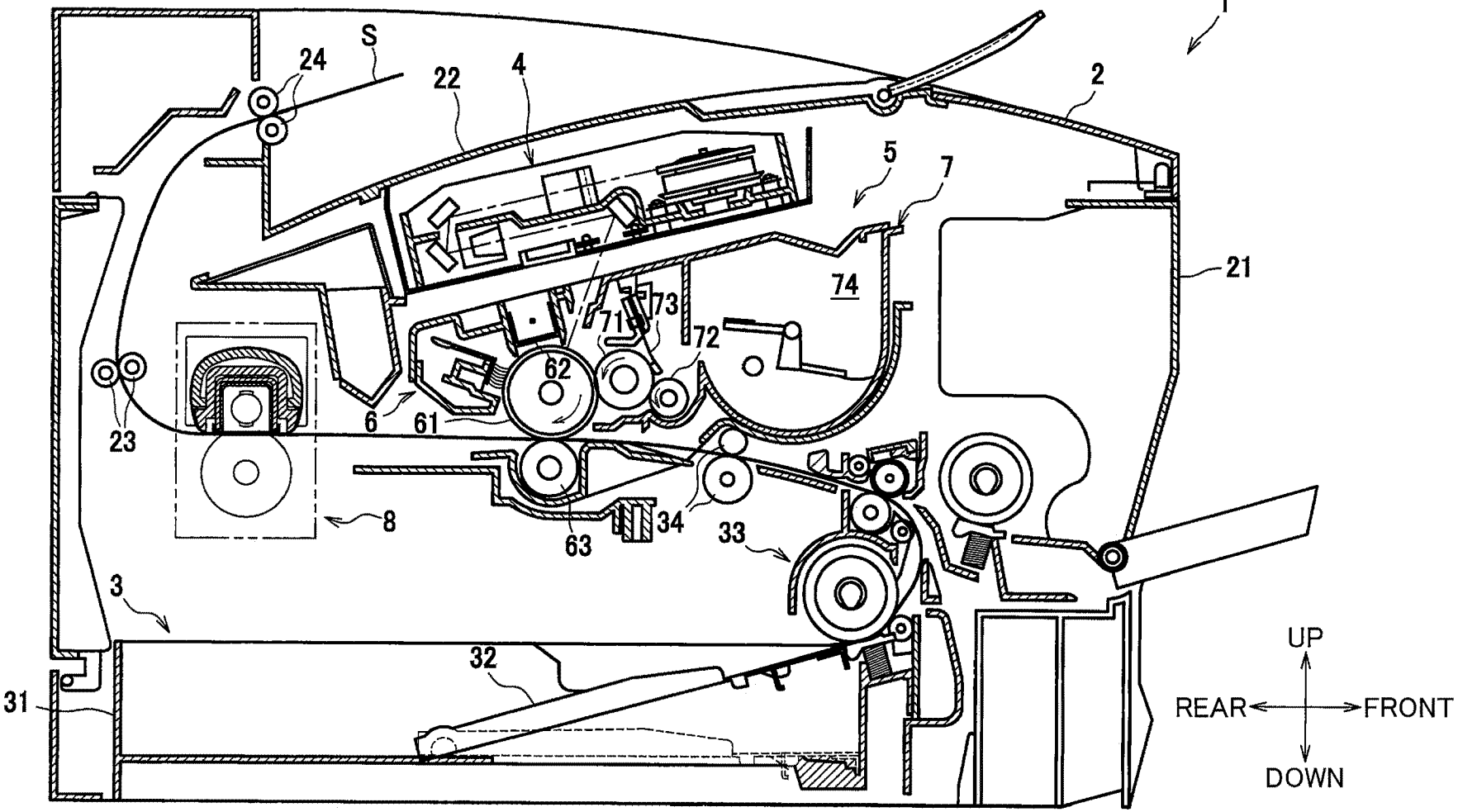
FIG. 1 is a schematic view showing an overall structure of a printer provided with a fixing device according to a first embodiment.

As shown in FIG. 1, the laser printer 1 includes a main casing 2 within which a sheet feeder 3, an exposure device 4, a process cartridge 5, and the fixing device 8 are disposed.

The sheet feeder 3 is disposed in a bottom section of the main casing 2. The sheet feeder 3 primarily includes a sheet-feeding tray 31, a sheet-pressing plate 32, and a sheet-feeding mechanism 33. The sheet-feeding tray 31 is configured to accommodate sheets S of paper. The sheet-pressing plate 32 is configured to lift front ends of the sheets S toward the sheet-feeding mechanism 33. The sheet-feeding mechanism 33 is configured to supply the sheets S to the process cartridge 5.

The exposure device 4 is disposed in a top section of the main casing 2. The exposure device 4 includes a light source device (not shown) and a polygon mirror, lenses, reflectors, and the like (shown without reference numerals). In the exposure device 4 having this configuration, the light source device is configured to irradiate a laser beam (depicted by a chain line in FIG. 1) based on image data, and the beam is scanned over a surface of a photosensitive drum 61 described later at a high speed to expose the surface of the photosensitive drum 61 to light.

The process cartridge 5 is disposed below the exposure device 4. The process cartridge 5 is detachably mountable in the main casing 2 through an opening formed in the main casing 2. This opening can be exposed when a front cover 21 provided on the main casing 2 is opened. The process cartridge 5 includes a drum unit 6, and a developing unit 7. The drum unit 6 primarily includes the photosensitive drum 61, a charger 62, and a transfer roller 63. The developing unit 7 is detachably mountable on the drum unit 6. The developing unit 7 primarily includes a developing roller 71, a supply roller 72, a thickness-regulating blade 73, and a toner-accommodating section 74.

In the process cartridge 5 described above, the charger 62 is configured to uniformly charge the surface of the photosensitive drum 61, after which the surface is exposed to the laser beam irradiated from the exposure device 4, forming an electrostatic latent image on the photosensitive drum 61 based on image data. In addition, the supply roller 72 is configured to supply toner in the toner-accommodating section 74 onto the developing roller 71. The toner carried on the developing roller 71 is then regulated into a thin layer having a uniform thickness by the thickness-regulating blade 73. The developing roller 71 is configured to supply the toner to the electrostatic latent image formed on the photosensitive drum 61, thereby developing the latent image into a visible toner image. Subsequently, the toner image borne on the photosensitive drum 61 is configured to be transferred onto a sheet S as the sheet S is conveyed between the photosensitive drum 61 and transfer roller 63.

The fixing device 8 is disposed rearward of the process cartridge 5. Hereinafter, detailed structure of the fixing device 8 will be described with reference to FIGS. 2A to 7.

Figure 2A:
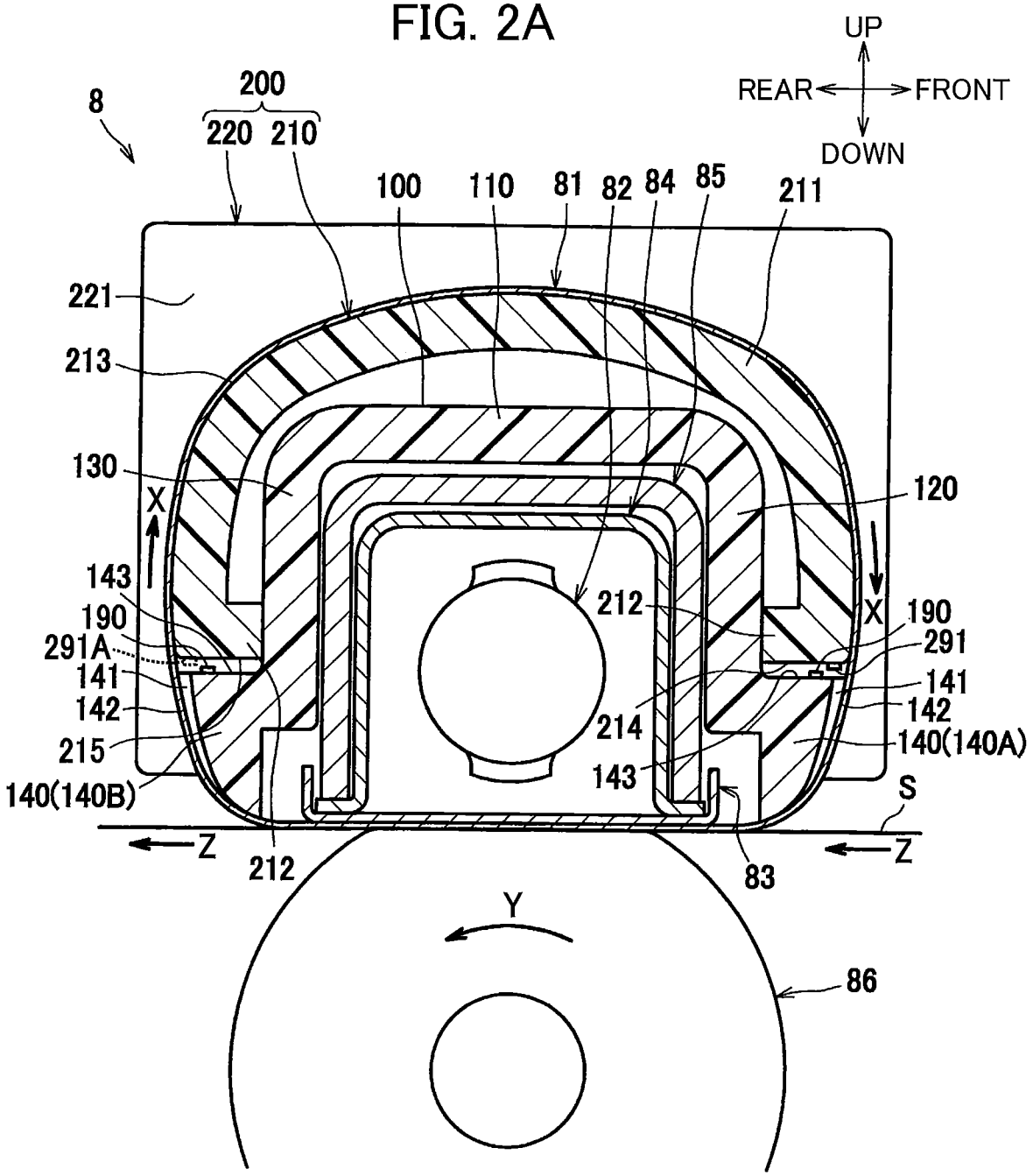
FIG. 2A is a cross-sectional side view of the fixing device according to the first embodiment.

As shown in FIG. 2A, the fixing device 8 primarily includes an endless belt 81 (as an example of a belt and an endless belt), a halogen lamp 82, a nip member 83, a reflection member 84, a stay 85, a pressure roller 86, a guide member 100 (an example of a guide), and a pair of end guide members 200 (an example of an end guide).

Figure 2B:
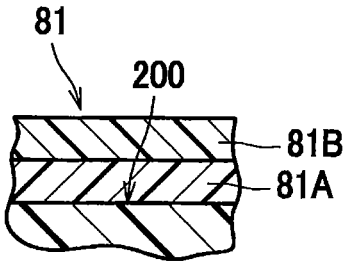
FIG. 2B is a cross-sectional view of an endless belt of the fixing device according to the first embodiment.

The endless belt 81 is a tubular-shaped belt having heat resistance and flexibility. The endless belt 81 is configured to circularly move clockwise in FIG. 2A (indicated by arrows X), while an inner peripheral surface thereof is guided by the guide member 100 and end guide members 200. As shown in FIG. 2B, the endless belt 81 includes a base layer 81A, and a release layer 81B.

The base layer 81A is made of a heat-resistant resin, such as polyimide resin. The base layer 81A has a tubular shape that is endless in a circumferential direction thereof and that is elongated in a left-right direction. The release layer 81B is formed of a fluoropolymer, for example. The release layer 81B covers an outer surface of the base layer 81A. The endless belt 81 is arranged such that an inner surface of the base layer 81A is configured to contact the guide member 100 and the end guide members 200, and the outer surface of the release layer 81B is configured to contact the sheets S. That is, the inner surface of the base layer 81A serves as the inner peripheral surface of the endless belt 81. Providing the release layer 81B on the outer surface of the base layer 81A can reduce the likelihood of toner becoming deposited on an outer peripheral surface of the endless belt 81.

Returning to FIG. 2A, the halogen lamp 82 is disposed at an inner space defined by the inner peripheral surface of the endless belt 81. The halogen lamp 82 functions as a heater configured to generate heat when powered. The halogen lamp 82 is thus configured to heat the nip member 83 and endless belt 81, which in turn can transfer the heat to the toner carried on the sheets S.

The nip member 83 is a plate-shaped member that can absorb the heat radiated from the halogen lamp 82. The nip member 83 is disposed in the inner space formed by the endless belt 81 so as to contact the inner peripheral surface of the endless belt 81. The nip member 83 is formed of a material having high thermal conductivity, such as aluminum sheet, in order to transfer the heat radiated by the halogen lamp 82 to the toner on the sheet S through the endless belt 81.

The reflection member 84 is disposed in the inner space defined by the endless belt 81 so as to surround the halogen lamp 82. The reflection member 84 is configured to reflect the heat from the halogen lamp 82 toward the nip member 83. The reflection member 84 is formed of a material that has high reflectance of infrared and far-infrared rays, such as aluminum sheet. The reflection member 84 is fabricated by curving the aluminum sheet into a form having a substantially U-shaped cross section.

The stay 85 is arranged to cover the reflection member 84. The stay 85 serves to support the nip member 83 via the reflection member 84 to ensure rigidity of the nip member 83 that is applied with load from the pressure roller 86. The stay 85 is formed of a material having relatively high rigidity, such as a steel plate. The stay 85 is fabricated by curving the steel plate into a shape having a substantially U-shaped cross section.

The pressure roller 86 is disposed below the nip member 83 with the endless belt 81 interposed therebetween. The pressure roller 86 is a roller configured to convey the sheet S with the sheet S nipped between the pressure roller 86 and the nip member 83, and more accurately between the pressure roller 86 and the endless belt 81 moving over the nip member 83. Upon receipt of a drive force transmitted from a motor (not shown), the pressure roller 86 is driven to rotate counterclockwise in FIG. 2 (indicated by an arrow Y). As the pressure roller 86 rotates counterclockwise, the endless belt 81 is circularly moved clockwise in FIG. 2A. In this way, in the fixing device 8, the sheets S is configured to be conveyed in a prescribed direction Z (from front to rear in the present embodiment, to be referred to as "sheet-conveying direction Z" hereinafter) between the endless belt 81 and pressure roller 86.

In this fixing device 8, a toner image that has been transferred onto the sheet S is thermally fixed thereon, while the sheet S is conveyed between the endless belt 81 and pressure roller 86. After the fixing device 8 has thermally fixed the toner image to the sheet S, pairs of conveying rollers 23 and 24 are configured to discharge the sheet S onto a discharge tray 22, as shown in FIG. 1.

Next, structures of the guide member 100 and end guide members 200 will be described in detail.

In the embodiment, a "width direction" is coincident with the left-right direction that is orthogonal to a circulating direction of the endless belt 81 and a moving direction of the endless belt 81 at a prescribed location. Put another way, the width direction in the embodiment corresponds to a longitudinal direction of the halogen lamp 82 and an axial direction of the pressure roller 86. In the following description, the moving direction of the endless belt 81 will be called a "belt-moving direction X."

Figures 3A, 3B:
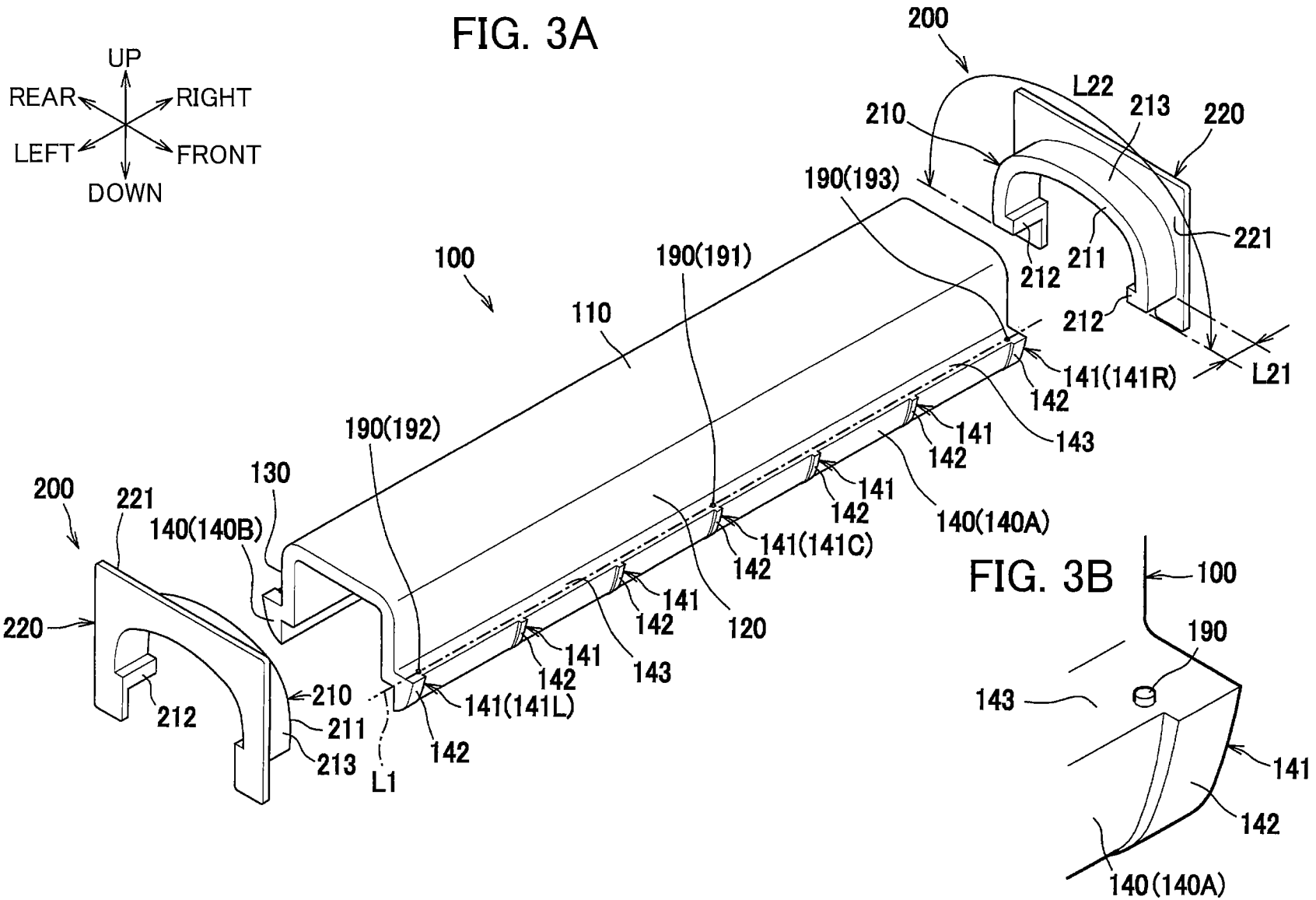
FIG. 3A is a perspective view showing the guide member and end guide members according to the first embodiment.
FIG. 3B is a partially-enlarged perspective view showing an area near a rightmost rib of the guide member according to the first embodiment.

As shown in FIGS. 2A and 3A, the guide member 100 is elongated in the width direction and is shaped to cover the stay 85. The guide member 100 is positioned opposite the halogen lamp 82 with respect to the stay 85. The guide member 100 primarily includes a top wall 110, a front wall 120, a rear wall 130 and a pair of guide portions 140. The front wall 120 extends downward from a front end of the top wall 110. The rear wall 130 extends downward from a rear end of the top wall 110. The guide portions 140 are elongated in the width direction.

Specifically, the guide portions 140 are configured of a front guide portion 140A, and a rear guide portion 140B. The front guide portion 140A is shaped to protrude forward from a bottom end of the front wall 120 and then extend downward. Similarly, the rear guide portion 140B is shaped to protrude rearward from a bottom end of the rear wall 130 and then extend downward. The front guide portion 140A and the rear guide portion 140B are an example of a guide portion of the guide.

When viewed in the width direction, the front guide portion 140A is tapered as extending from the top toward the bottom in FIG. 2A. That is, the front guide portion 140A is tapered from upstream toward downstream in the belt-moving direction X at guide surfaces 142 (described later). Similarly, when viewed in the width direction, the rear guide portion 140B is tapered as extending from the top toward the bottom in FIG. 2A. That is, the rear guide portion 140B is tapered from downstream toward upstream in the belt-moving direction X at the guide surfaces 142.

In the embodiment, the front guide portion 140A and rear guide portion 140B are substantially symmetrical in the front-rear direction. Therefore, the structure of the guide portions 140 will be described below while primarily referring to the front guide portion 140A.

Each guide portion 140 has an outer surface on which a plurality of ribs 141 is formed, the outer surface of each guide portion 140 facing the inner peripheral surface of the endless belt 81. The ribs 141 are aligned in the width direction. Each rib 141 protrudes from the outer surface of the corresponding guide portion 140 toward the inner peripheral surface of the endless belt 81. The ribs 141 extend in the belt-moving direction X, that is, substantially vertically.

Each rib 141 has a guide surface 142. The guide surfaces 142 of the ribs 141 are configured to contact the inner peripheral surface of the endless belt 81 to guide the circular movement of the endless belt 81. The guide surfaces 142 are an example of a guide surface. Two of the plurality of ribs 141 arranged outermost in the width direction will be referred to as a leftmost rib 141L and a rightmost rib 141R, respectively, hereinafter. The leftmost rib 141L is an example of a first rib, and the rightmost rib 141R is an example of a second rib. Further, one of the plurality of ribs 141 arranged center in the width direction will be referred to as a center rib 141C, hereinafter. In the width direction, the leftmost and rightmost ribs 141L and 141R have a dimension larger than those of remaining ribs 141 including the center rib 141C arranged between the leftmost and rightmost ribs 141L and 141R. Lubricant, such as grease, is provided between the endless belt 81 and the guide portion 140 to enhance sliding performance of the inner peripheral surface of the endless belt 81 over the guide surfaces 142.

Figure 2C:
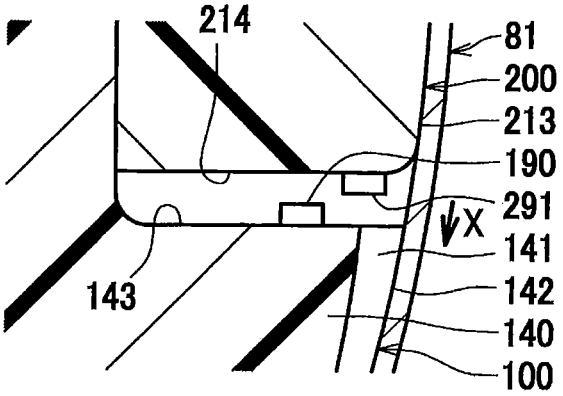
FIG. 2C is an enlarged cross-sectional side view showing an area near a gate mark on a front guide portion of a guide member according to the first embodiment.

The guide member 100 is formed of resin material containing elongated-shaped fillers 150 (see FIG. 4), such as glass fibers, to improve strength and heat-resistance. As shown in FIGS. 2C, 3A and 3B, gate marks 190 are formed on the guide member 100. The gate marks 190 are left as a result of an injection molding process to manufacture the guide member 100. The gate marks 190 are traces that indicate positions of gates 320 provided in a mold 300 (see FIG. 5). That is, the gate marks 190 indicate where the resin material was injected into the mold 300 during the injection molding process.

Specifically, the gate marks 190 are formed at a top surface 143 of the front guide portion 140A and at a top surface 143 of the rear guide portion 140B. The surface 143 of the front guide portion 140A is a surface that extends in the width direction and that constitutes an upstream portion of the front guide portion 140A relative to the guide surfaces 142 in the belt-moving direction X. The top surface 143 of the rear guide portion 140B is a surface that extends in the width direction and that constitutes a downstream portion of the rear guide portion 140B relative to the guide surfaces 142 in the belt-moving direction X.

More specifically, a plurality of gate marks 190 (specifically, three gate marks 190 in the embodiment) is formed on the top surface 143 of each guide portion 140. The gate marks 190 are generally columnar-shaped and protrude in the same direction as each other (i.e., upward) from the top surface 143 of the corresponding guide portion 140.

Figures 4A, 4B, 4C, 4D:
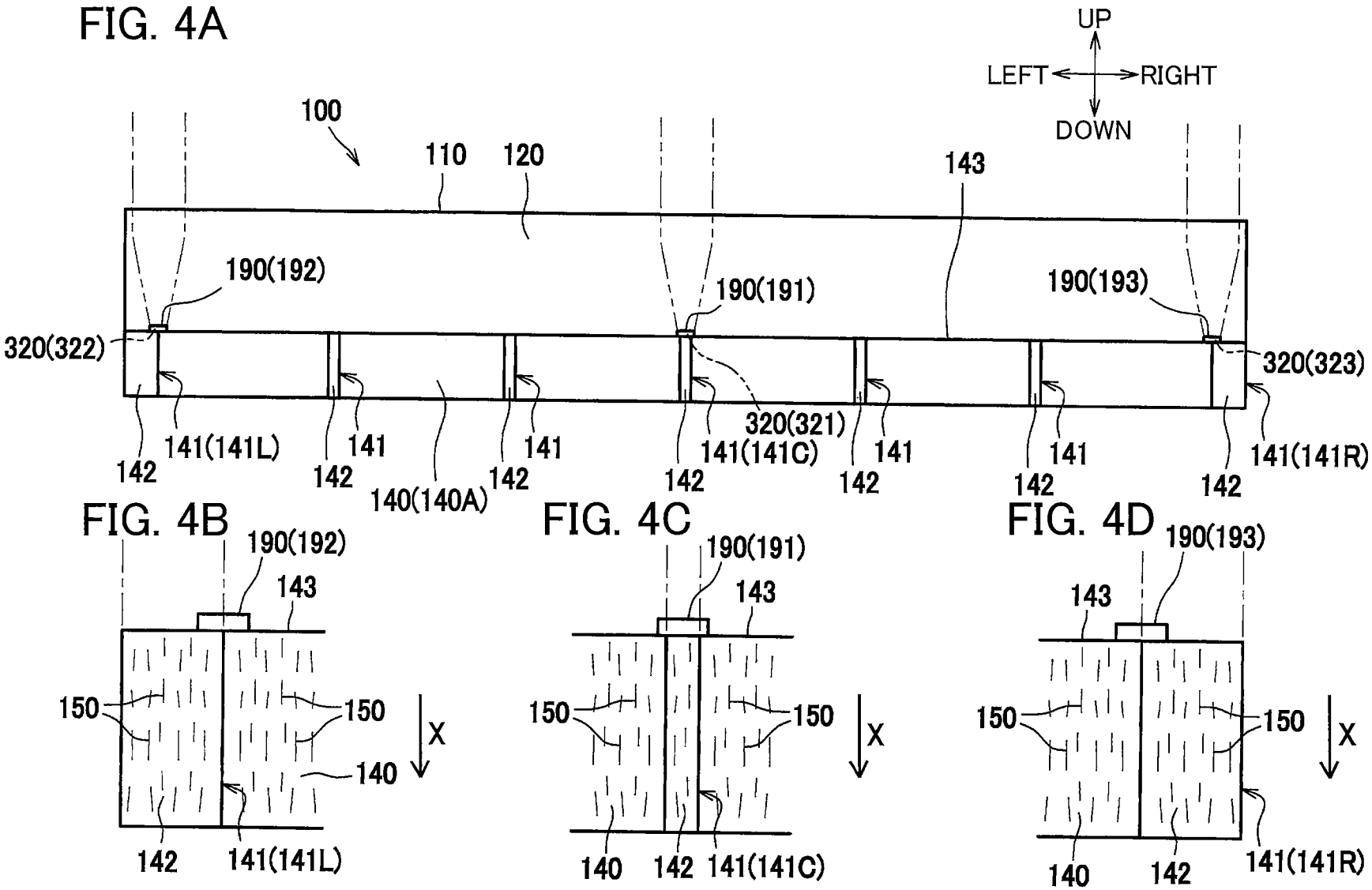
FIG. 4A is a front view of the guide member according to the first embodiment.
FIG. 4B is a partially-enlarged view showing an area near a leftmost rib of the guide member according to the first embodiment.
FIG. 4C is a partially-enlarged view showing an area near a center rib of the guide member according to the first embodiment.
FIG. 4D is a partially-enlarged view showing an area near the rightmost rib of the guide member according to the first embodiment.

As shown in FIG. 4A, the three gate marks 190 of each guide portion 140 include a first gate mark 191, a second gate mark 192, and a third gate mark 193. The first gate mark 191, second gate mark 192, and third gate mark 193 are arranged to be spaced apart from one another in the width direction. That is, the first gate mark 191, second gate mark 192, and third gate mark 193 are arranged in line along a phantom line L1 shown in FIG. 3A. Specifically, in the width direction, the first gate mark 191 is disposed at generally center on the top surface 143; the second gate mark 192 is disposed on a left end portion of the top surface 143; and the third gate mark 193 is disposed on a right end portion of the top surface 143.

Each of the gate marks 190 is disposed at a position corresponding to one of the ribs 141 in the width direction. Here, a position corresponding to a certain rib 141 denotes such a position that the gate mark 190 at least partially overlaps the rib 141 in the width direction when viewed in a direction orthogonal to the corresponding guide surface 142. Specifically, as shown in FIG. 4C, the first gate mark 191 is disposed at a position corresponding to the center rib 141C positioned at the widthwise center of the guide portion 140. That is, the first gate mark 191 is arranged at a position overlapping with an entirety of the center rib 141C in the width direction when viewed in a direction orthogonal to the guide surface 142 of the center rib 141C.

As shown in FIG. 4B, the second gate mark 192 is disposed at a position corresponding to the leftmost rib 141L, that is, at a position overlapping with a right edge of the leftmost rib 141L in the width direction when viewed in a direction orthogonal to the guide surface 142 of the leftmost rib 141L. The second gate mark 192 is positioned upstream relative to the guide surface 142 in the belt-moving direction X. The second gate mark 192 is an example of a first gate mark.

As shown in FIG. 4D, the third gate mark 193 is disposed at a position corresponding to the rightmost rib 141R, that is, at a position overlapping with a left edge of the rightmost rib 141R in the width direction when viewed in a direction orthogonal to the guide surface 142 of the rightmost rib 141R. The third gate mark 193 is positioned upstream relative to the guide surface 142 in the belt-moving direction X. The third gate mark 193 is an example of a second gate mark.

FIGS. 2A and 3A show the end guide members 200. The end guide members 200 are configured to guide the inner peripheral surface of the endless belt 81 and to regulate the position of the endless belt 81 in the width direction. The end guide members 200 are arranged one on each end of the endless belt 81 in the width direction. Each end guide member 200 primarily includes an inner guide portion 210 (an example of a guide portion of the end guide), and a restricting portion 220.

The inner guide portion 210 is a portion for guiding the inner peripheral surface of the endless belt 81. As shown in FIG. 3A, the inner guide portion 210 has a dimension L21 in the width direction that is smaller (shorter) than a dimension L22 in the belt-moving direction X (i.e., a circumferential length of a guide surface 213, described later). In other words, the inner guide portion 210 is NOT elongated in the width direction, unlike the guide portions 140 of the guide member 100. The inner guide portion 210 primarily includes a wall portion 211 and extended end portions 212.

The wall portion 211 is curved to have an arcuate shape whose convex side faces upward when viewed in the width direction. That is, when viewed in the width direction, the wall portion 211 extends in the belt-moving direction X. The extended end portions 212 extend inward from respective ends (front and rear ends) of the wall portion 211 when viewed in the width direction.

The wall portion 211 has an outer circumferential surface that serves as the guide surface 213. The guide surface 213 is a surface configured to contact the inner peripheral surface of the endless belt 81 on the corresponding widthwise end thereof for guiding the endless belt 81. The guide surface 213 is an example of a guide surface of the end guide. Thus, the widthwise ends of the endless belt 81 are configured to be guided by the guide surfaces 142 on the rear guide portion 140B, the guide surface 213 on the inner guide portion 210, and the guide surfaces 142 on the front guide portion 140A. Lubricant is provided between the endless belt 81 and the inner guide portion 210 for improving sliding performance between the inner peripheral surface of the endless belt 81 and the guide surface 213.

The restricting portion 220 is a portion serving to restrict the position of the endless belt 81 in the width direction. The restricting portion 220 has a wall-like structure that protrudes outward in a direction corresponding to a thickness direction of the endless belt 81 from an outer edge of the corresponding inner guide portion 210 in the width direction. The restricting portion 220 has a flat surface (inner surface) facing the endless belt 81 in the width direction, the flat surface serving as a restricting surface 221.

The restricting surface 221 is configured to contact a corresponding widthwise edge of the endless belt 81 when the endless belt 81 is displaced in the width direction, thereby restricting the endless belt 81 from being displaced farther in the width direction. Both of the restricting surfaces 221 define a distance therebetween in the width direction that is slightly greater than a widthwise length of the endless belt 81. With this structure, the widthwise edges of the endless belt 81 can be contacted and restricted by the restricting surfaces 221 only when the endless belt 81 is displaced in the width direction.

The end guide members 200 are formed of a resin material containing the elongated-shaped fillers 150 (see FIG. 7), such as glass fibers, in order to improve strength and heat-resistance. As shown in FIGS. 2A and 2C, a gate mark 291 is formed on each end guide member 200 during an injection molding process for manufacturing the same. The gate mark 291 indicates where the resin material was injected through a gate 420 (see FIG. 6) during the injection molding process.

Specifically, the gate mark 291 is formed on an endface 214 constituting a bottom edge of the inner guide part 210 that is positioned downstream of the guide surface 213 in the belt-moving direction X at the guide surface 213 (hereinafter called a "downstream endface 214"). That is, the downstream endface 214 defines a downstream edge of the inner guide portion 210 in the belt-moving direction X. In other words, the gate mark 291 is provided at a position aligned with the guide surface 213 of each end guide member 200 in the width direction and downstream of the guide surface 213 of the inner guide portion 210 in the belt-moving direction X. The gate mark 291 is provided at a position corresponding to the guide surface 213 in the width direction and downstream of the guide surface 213 of the inner guide portion 210 in the belt-moving direction X. More specifically, the gate mark 291 is disposed on the downstream endface 214 at a position downstream of the wall portion 211, rather than downstream of the corresponding extended end portion 212 (i.e., a position closer to the front). Accordingly, when viewed in a direction orthogonal to the downstream endface 214, the gate mark 291 is disposed at a position overlapping with the wall portion 211. The gate mark 291 is a generally columnar-shaped protrusion that protrudes generally downward from the downstream endface 214.

Next, methods of manufacturing the guide member 100 and end guide members 200 will be described.

Figure 5:
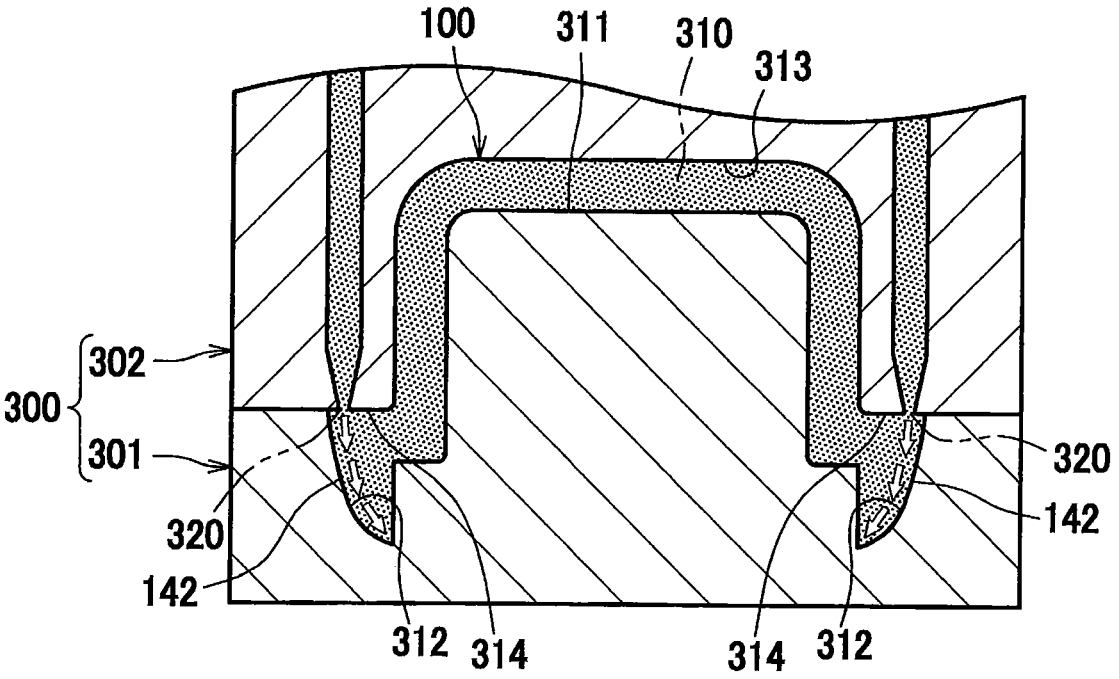
FIG. 5 is an explanatory view illustrating a structure of a mold for molding the guide member according to the first embodiment and explaining a method of manufacturing the guide member according to the first embodiment.
Figure 6:
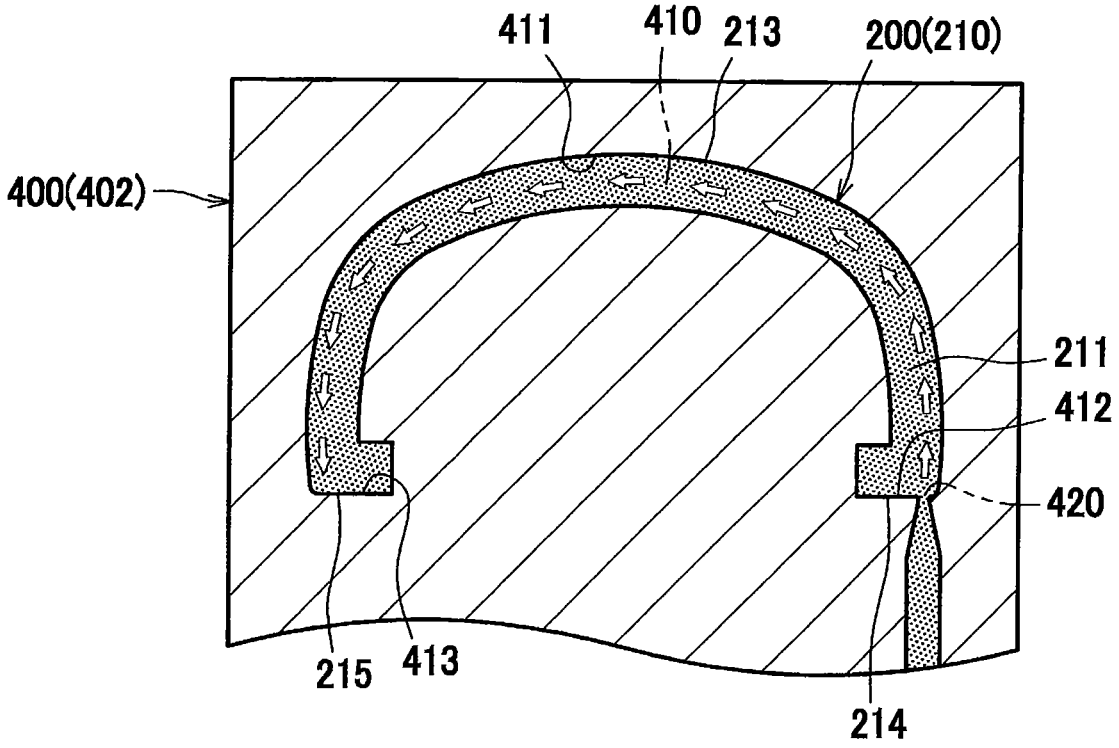
FIG. 6 is an explanatory view illustrating a structure of a mold for molding the end guide member according to the first embodiment and explaining a method of manufacturing the end guide member according to the first embodiment.

In the first embodiment, the mold 300 shown in FIG. 5 is used as a mold for manufacturing the guide member 100, and a mold 400 shown in FIG. 6 is used as a mold for manufacturing the end guide member 200. First, the structures of the molds 300 and 400 will be described.

As shown in FIG. 5, the mold 300 for molding the guide member 100 includes a cavity 310 whose shape is in conformance with the shape of the guide member 100, and gates 320 through which the resin material is injected into the cavity 310. Specifically, in the present embodiment, the mold 300 is configured of a fixed mold 301, and a movable mold 302.

The fixed mold 301 has an inner-surface molding surface 311 and outer-surface molding surfaces 312. The inner-surface molding surface 311 is used for molding an inner surface of the guide member 100. The outer-surface molding surfaces 312 are used for molding the outer surfaces of the front and rear guide portions 140 (140A and 140B) including the ribs 141. The movable mold 302 has an outer molding surface 313 and top molding surfaces 314. The outer molding surface 313 is used for molding outer surfaces of the top wall 110, front wall 120, and rear wall 130. The top molding surfaces 314 is used for molding the top surfaces 143 of the front and rear guide portions 140 (140A and 140B). The gates 320 are provided at the respective top molding surfaces 314.

Specifically, as indicated by phantom lines in FIG. 4A, the gates 320 are provided to oppose the top surfaces 143 of the guide portions 140. A plurality of the gates 320 (specifically three gates 320 in the present embodiment) is provided at each of the top molding surfaces 314. Specifically, the three gates 320 include a first gate 321, a second gate 322, and a third gate 323 that are arranged at intervals in the width direction. More specifically, the first gate 321 is disposed in a center portion of the corresponding top molding surface 314 in the width direction; the second gate 322 is disposed in a left end portion of the corresponding top molding surface 314; and the third gate 323 is disposed in a right end portion of the corresponding top molding surface 314.

Each of the gates 320 is positioned to correspond to one of the ribs 141 in the width direction. Specifically, the first gate 321 is disposed at a position corresponding to the center rib 141C, i.e., a position overlapping with the entirety of the center rib 141C in the width direction. The second gate 322 is disposed at a position corresponding to the leftmost rib 141L, i.e., at a position overlapping with the right edge of the leftmost rib 141L in the width direction. The third gate 323 is disposed at a position corresponding to the rightmost rib 141R, i.e., a position overlapping with the left edge of the rightmost rib 141R in the width direction.

As shown in FIG. 6, the mold 400 for molding the end guide member 200 has a cavity 410 shaped in conformance with the shape of the end guide member 200, and a gate 420 through which the resin material is injected into the cavity 410. Specifically, in the present embodiment, the mold 400 is configured of a movable mold 402, and a fixed mold (not shown) for molding the restricting portion 220 together with the movable mold 402.

The movable mold 402 has a guide-portion molding surface 411 that is used for molding the inner guide portion 210. The guide-portion molding surface 411 has a downstream-endface molding surface 412 for molding the downstream endface 214 of the inner guide portion 210. The downstream endface 214 is an example of a second surface, and the downstream-endface molding surface 412 is an example of a second molding surface. The gate 420 is provided at the downstream-endface molding surface 412. Specifically, at the downstream endface molding surface 412, the gate 420 is provided at a position opposing the downstream endface 214 (the endface of the wall portion 211 located downstream in the belt-moving direction X at the guide surface 213). With this configuration, the gate 420 is positioned to be overlapped with the wall portion 211 when viewed in a direction orthogonal to the downstream endface 214.

Figure 8:
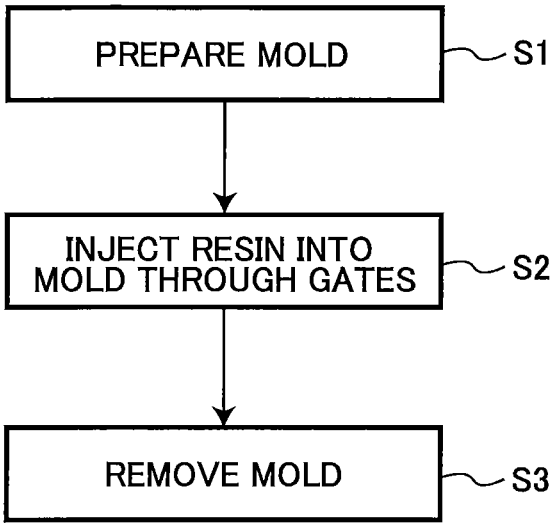
FIG. 8 is a flow chart explaining a process for manufacturing the guide member according to the first embodiment.

Referring to FIG. 8, in order to manufacture the guide member 100, first, a step (S1) for preparing the mold 300 as illustrated in FIG. 5 is performed. Specifically, in this step S1, the fixed mold 301 and movable mold 302 are clamped together to form the cavity 310.

Next, the resin containing the fillers 150 is injected into the cavity 310 through the gates 320 in step S2. Since the plurality of gates 320 is arranged to be spaced apart from one another in the width direction on the respective top molding surfaces 314 that mold the top surfaces 143 of the guide member 100, the resin injected into the mold 300 is caused to flow in the belt-moving direction X near the guide surfaces 142 of the ribs 141, as indicated by thick arrows in FIG. 5.

Here, the expression "in the belt-moving direction X" does not necessarily represent a direction parallel to the belt-moving direction X, but may include a direction substantially parallel to the belt-moving direction X. Here, the expression "in the belt-moving direction X" may include a direction that forms an angle of 30° to the belt-moving direction X, for example.

After the resin has solidified, the molded guide member 100 is ejected from the mold 300 (step S3). This completes the process for manufacturing the guide member 100.

Figure 9:
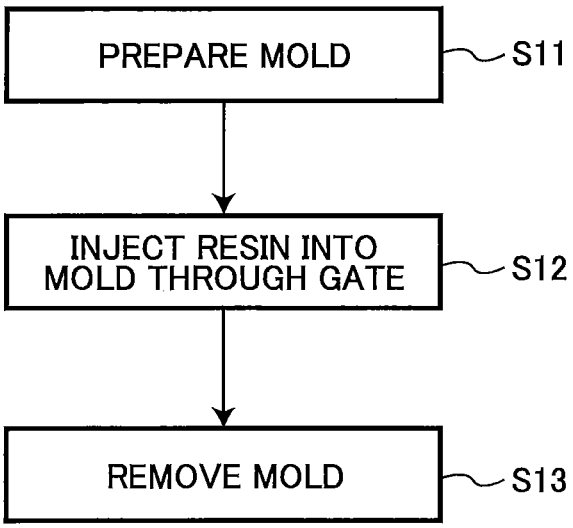
FIG. 9 is a flow chart explaining a process for manufacturing the end guide member according to the first embodiment.

Referring to FIG. 9, to begin the process for manufacturing the end guide member 200, a step (S11) for preparing the mold 400 shown in FIG. 6 is performed. Specifically, this preparation step (S11) involves clamping the movable mold 402 to the fixed mold (not shown) to form the cavity 410.

Next, the resin containing the fillers 150 is injected into the cavity 410 through the gate 420 in step S12. Here, the gate 420 is provided in the downstream-endface molding surface 412 that is adapted to mold the downstream endface 214 of the inner guide portion 210. Accordingly, the injected resin can flow in the belt-moving direction X near the guide surface 213 of the wall portion 211, as indicated by thick arrows in FIG. 6.

After the resin has solidified, a step (S13) is performed to eject the molded end guide member 200 from the mold 400, thereby completing the process for manufacturing the end guide member 200.

With the above-described methods according to the first embodiment, when injecting the resin into the cavity 310 and cavity 410 through the corresponding gates 320 and 420 to mold the guide member 100 and end guide member 200, the injected resin can flow in the belt-moving direction X near the guide surfaces 142 and 213. With this method, as illustrated in FIGS. 4B through 4D and FIG. 7, the elongated fillers 150 can be oriented such that a longitudinal direction of the fillers 150 is aligned with the belt-moving direction X near the guide surfaces 142 and 213. Successfully orienting the fillers 150 in this way can suppress wearing of the inner peripheral surface of the endless belt 81 by the fillers 150 exposed on the guide surfaces 142 and 213, thereby improving the durability of the endless belt 81.

Note that it is not essential that all of the elongated-shaped fillers 150 be longitudinally oriented in the belt-moving direction X, provided that a ratio of fillers 150 oriented in the belt-moving direction X to those fillers 150 not oriented in the belt-moving direction X is sufficiently greater than the same ratio obtained with conventional techniques. Here, the expression "oriented in the belt-moving direction X" signifies, for example, that the longitudinal direction of the fillers 150 forms an angle less than 45° with the belt-moving direction X. Note that the fillers 150 are illustrated in a larger size than an actual size in the drawings for the sake of emphasis.

Further, since the gates 320 of the mold 300 are provided at positions corresponding to the ribs 141 in the width direction, the resin injected into the cavity 310 through the gates 320 near the guide surfaces 142 of the ribs 141 can flow more reliably in the belt-moving direction X at the guide surfaces 142. Accordingly, the majority of the fillers 150 can be longitudinally oriented in the belt-moving direction X at the guide surfaces 142 more reliably.

Further, since the gates 320 of the mold 300 are provided at positions corresponding to the outermost ribs 141L and 141R in the width direction, the fillers 150 exposed on the guide surfaces 142 of the outermost ribs 141L and 141R can be more reliably oriented in the belt-moving direction X. This is particularly advantageous, because the inner peripheral surface of the endless belt 81 is more firmly pressed against the guide surfaces 142 at the outermost ribs 141L and 141R in the width direction than the guide surfaces 142 of the remaining ribs 141 when the endless belt 81 becomes skewed, for example. Accordingly, wear on the inner peripheral surface of the endless belt 81 can be further suppressed, since the longitudinal direction of the fillers 150 exposed on these guide surfaces 142 is oriented in the belt-moving direction X.

Further, the gates 320 of the mold 300 are disposed at positions corresponding to the top surface 143 of each guide portion 140 that has a larger area than a bottom end surface of the corresponding guide portion 140. Accordingly, the plurality of gates 320 can be provided without increase in structural complexity of the guide member 100, thereby facilitating molding of the guide member 100.

Further, the gate 420 of the mold 400 is disposed at a position overlapping with the wall portion 211 when viewed in the direction orthogonal to the downstream endface 214. Hence, the resin injected through the gate 420 can flow unhindered along the guide-portion molding surface 411, thereby forming the wall portion 211 of the inner guide portion 210. That is, since the flow of the injected resin to mold the wall portion 211 is less likely to be disturbed, the majority of the fillers 150 contained in the injected resin can be reliably oriented in the belt-moving direction X at the guide surface 213 of the molded wall portion 211.

Note that the gate mark 291 formed on the end guide member 200 in the present embodiment is positioned downstream of the guide surface 213 of the inner guide portion 210 in the belt-moving direction X. However, the gate mark 291 may be disposed on upstream of the guide surface 213 in the belt-moving direction X, instead. Specifically, as indicated by a broken line in FIG. 2A, a gate mark 291A may be formed on an endface 215 constituting a bottom end of the inner guide portion 210 on the upstream side of the guide surface 213 in the belt-moving direction X (hereinafter called an "upstream endface 215"). That is, the upstream end face 215 defines an upstream edge of the inner guide portion 210 in the belt-moving direction X. Here, referring to FIG. 6, the mold 400 may be provided with a gate on an upstream-endface molding surface 413 for molding the upstream endface 215 of the inner guide portion 210. In this case, the gate (gate mark 291A) is preferably provided at a position overlapping with the wall portion 211, rather than the rear extended end portion 212, when viewed in a direction orthogonal to the upstream endface 215. The upstream endface 215 is an example of a third surface, and the upstream-endface molding surface 413 is an example of a third molding surface.

In the embodiment, the guide member 100 is provided with three gate marks 190 on each guide portion 140, but the disclosure is not limited to this arrangement. For example, the guide member may be provided with the same number of gate marks as the ribs formed on each guide portion. In this case, each of the gate marks may be disposed to correspond to each one of the ribs. Alternatively, some of the gate marks may be disposed at positions corresponding to the ribs, while remaining gate marks may be arranged to be offset from the remaining ribs in the width direction. That is, of all the gate marks, an arbitrary number of the gate marks may be disposed at positions corresponding to the ribs.

2. Second Embodiment

Next, a second embodiment will be described with reference to FIGS. 10A through 12. In the following description, like parts and components will be designated with the same reference numerals as those in the first embodiment to avoid duplicating description. Only differences from the first embodiment will be described in detail.

Figure 10A:
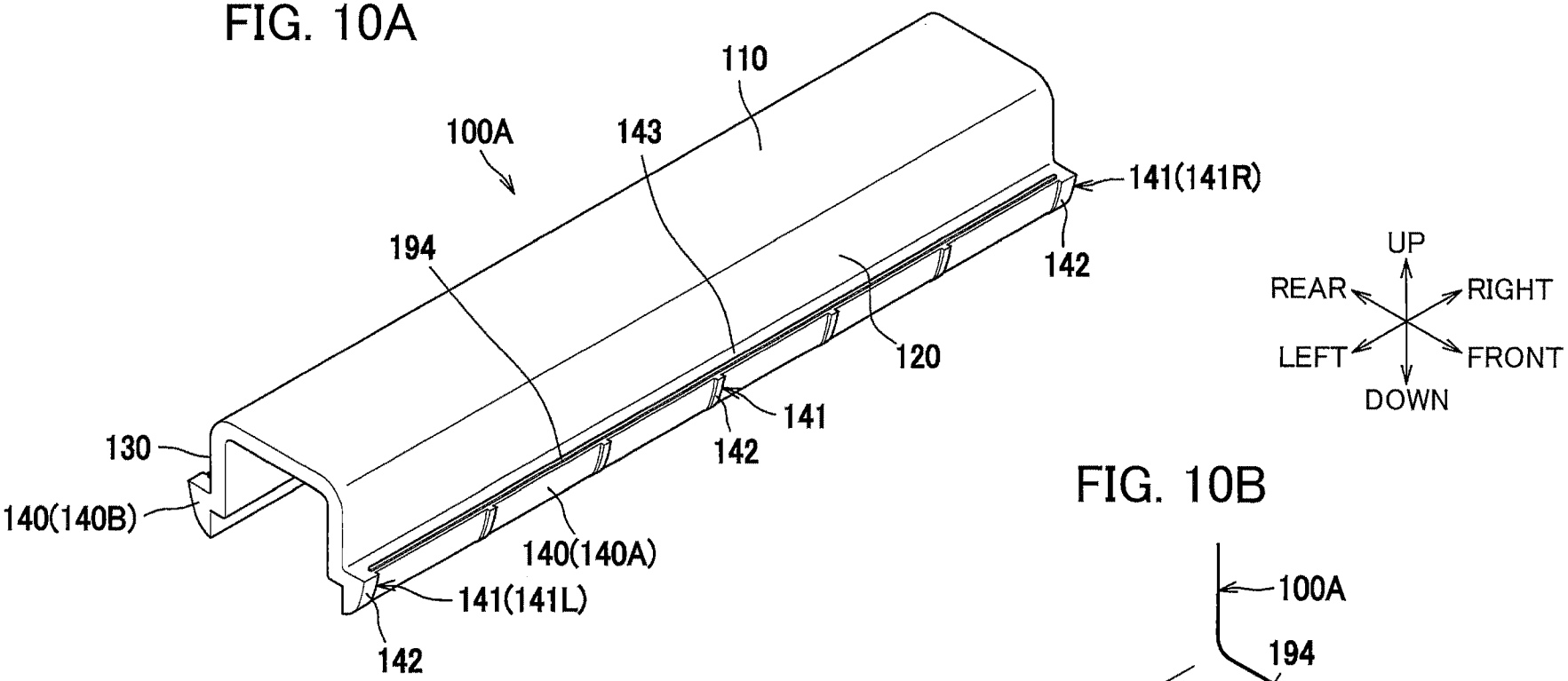
FIG. 10A is a perspective view of a guide member according to a second embodiment.
Figure 10B:
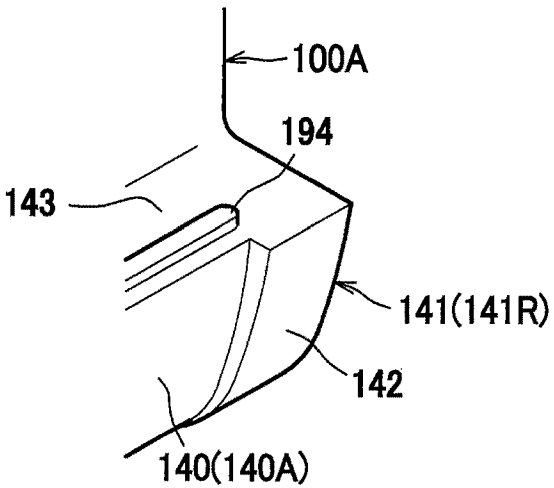
FIG. 10B is a partially-enlarged perspective view showing an area near a rightmost rib of the guide member according to the second embodiment.

As shown in FIGS. 10A and 10B, a guide member 100A according to the second embodiment includes a single gate mark 194 on the top surface 143 of each of the front and rear guide portions 140 (140A and 140B). Each gate mark 194 protrudes upward from the corresponding top surface 143 and has a ridge-like shape extending in the width direction.

That is, each gate mark 194 is disposed at a position corresponding to both of the outermost ribs 141 in the width direction. More specifically, each gate mark 194 is disposed at a position corresponding to the leftmost rib 141L and corresponding to the rightmost rib 141R.

Figures 11A, 11B, 11C, 11D:
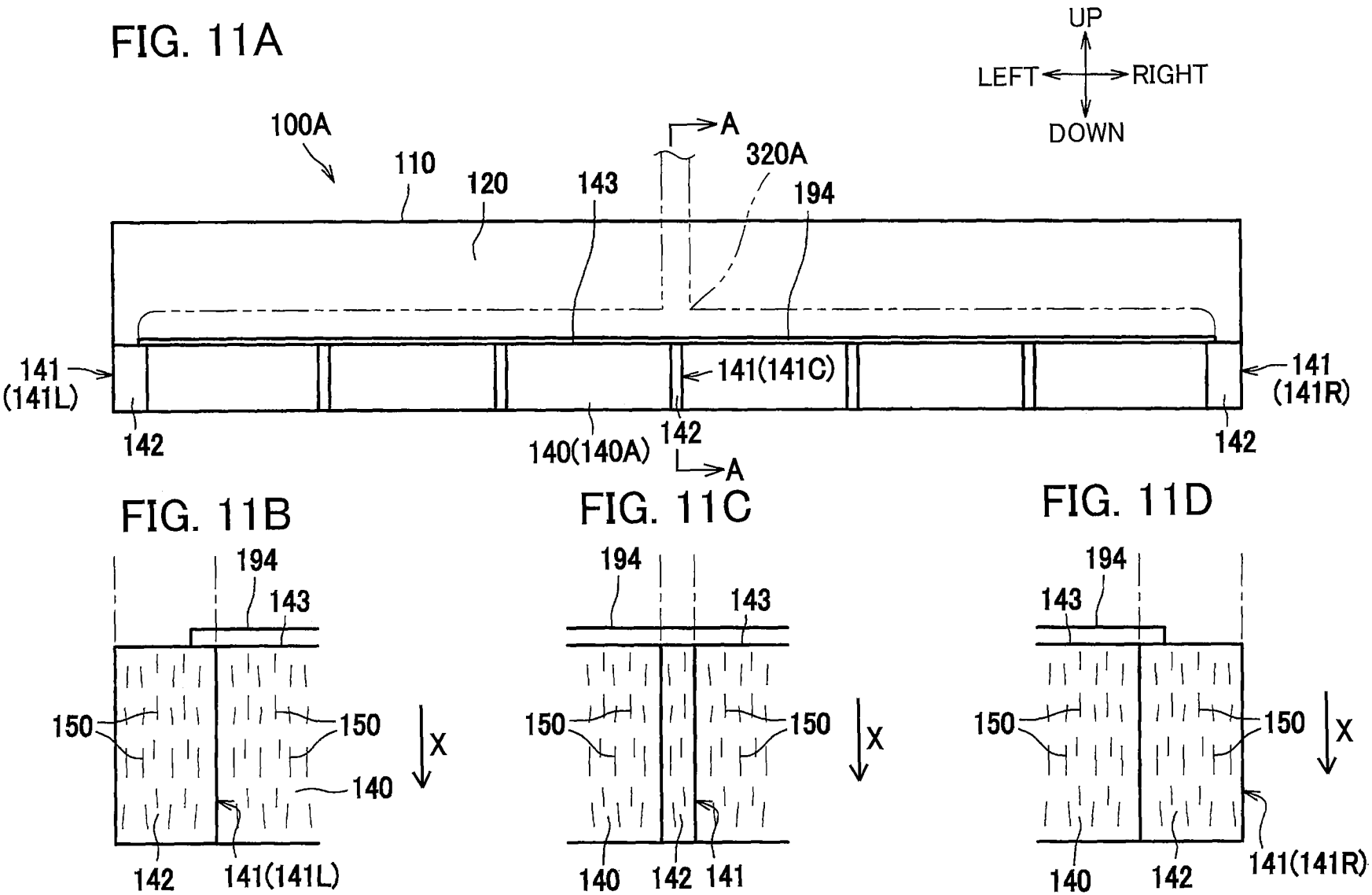
FIG. 11A is a front view of the guide member according to the second embodiment.
FIG. 11B is a partially-enlarged view showing an area near a leftmost rib of the guide member according to the second embodiment.
FIG. 11C is a partially-enlarged view showing an area near a center rib of the guide member according to the second embodiment.
FIG. 11D is a partially-enlarged view showing an area near the rightmost rib of the guide member according to the second embodiment.

As shown in FIG. 11B, each gate mark 194 has a left end portion that is arranged at a position overlapping with the right edge of the leftmost rib 141L in the width direction when viewed in a direction orthogonal to the guide surface 142 of the leftmost rib 141L. As shown in FIG. 11D, each gate mark 194 has a right end portion that is disposed at a position overlapping with the left edge of the rightmost rib 141R in the width direction when viewed in a direction orthogonal to the guide surface 142 of the rightmost rib 141R.

The gate mark 194 is formed to extend continuously from the position corresponding to the leftmost rib 141L to the position corresponding to the rightmost rib 141R.

Figure 12:
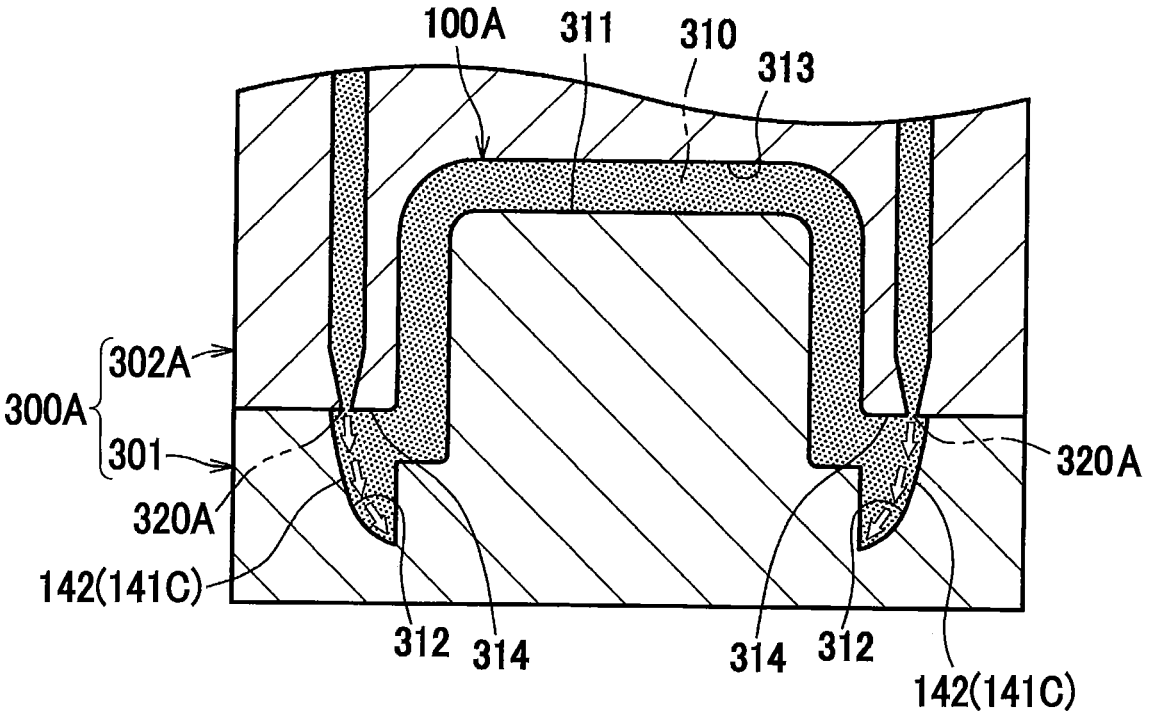
FIG. 12 is an explanatory view illustrating a structure of a mold for molding the guide member according to the second embodiment and explaining a method of manufacturing the guide member according to the second embodiment, wherein the mold is shown in cross-section taken along a plane A-A shown in FIG. 11A.

FIG. 12 shows a mold 300A for molding the guide member 100A of the second embodiment. The mold 300A includes the fixed mold 301 and a movable mold 302A. The movable mold 302A is provided with a single gate 320A at each of the top molding surfaces 314. In the second embodiment, the gates 320A have a slit-like shape that is elongated in the width direction. Each gate 320A extends continuously from a position corresponding to the leftmost rib 141L to a position corresponding to the rightmost rib 141R.

When resin containing the fillers 150 is injected through the gates 320A into the mold 300A having this configuration, the resin flows in the belt-moving direction X near the guide surfaces 142 of the ribs 141, as indicated by the arrows in FIG. 12. In the second embodiment in particular, the gates 320A have a slit-like shape elongated in the width direction and extend from the position corresponding to the leftmost rib 141L to the position corresponding to the rightmost rib 141R. Accordingly, the resin injected into the gates 320A can flow in the belt-moving direction X near the guide surfaces 142 of all the ribs 141.

This manufacturing method ensures that the fillers 150 overall are longitudinally oriented in the belt-moving direction X at all the guide surfaces 142, as illustrated in FIGS. 11B through 11D. This arrangement can suppress wear on the inner peripheral surface of the endless belt 81 by the fillers 150 exposed on the guide surfaces 142, thereby improving the durability of the endless belt 81.

Further, since the gates 320A are disposed at positions corresponding to the outermost ribs 141L and 141R in the width direction, this method can ensure that the fillers 150 overall are longitudinally oriented in the belt-moving direction X at the guide surfaces 142 of the outermost ribs 141L and 141R. Since the inner peripheral surface of the endless belt 81 tends to be pressed more firmly against the guide surfaces 142 of the outermost ribs 141L and 141R when the endless belt 81 becomes skewed, this arrangement of fillers 150 at these guide surfaces 142 can further suppress wear on the inner peripheral surface of the endless belt 81.

Note that, while the single gate 320A (gate mark 194) elongated in the width direction are provided for each of the top surfaces 143 of the front and rear guide portions 140 in the second embodiment, the present disclosure is not limited to this arrangement. For example, a plurality of gates (gate marks) elongated in the width direction may be arranged at intervals in the width direction. In this case, the leftmost gate (gate mark) is preferably disposed at a position corresponding to the leftmost rib, and the rightmost gate (gate mark) is preferably disposed at a position corresponding to the rightmost rib.

3. Third Embodiment

Figure 13A:
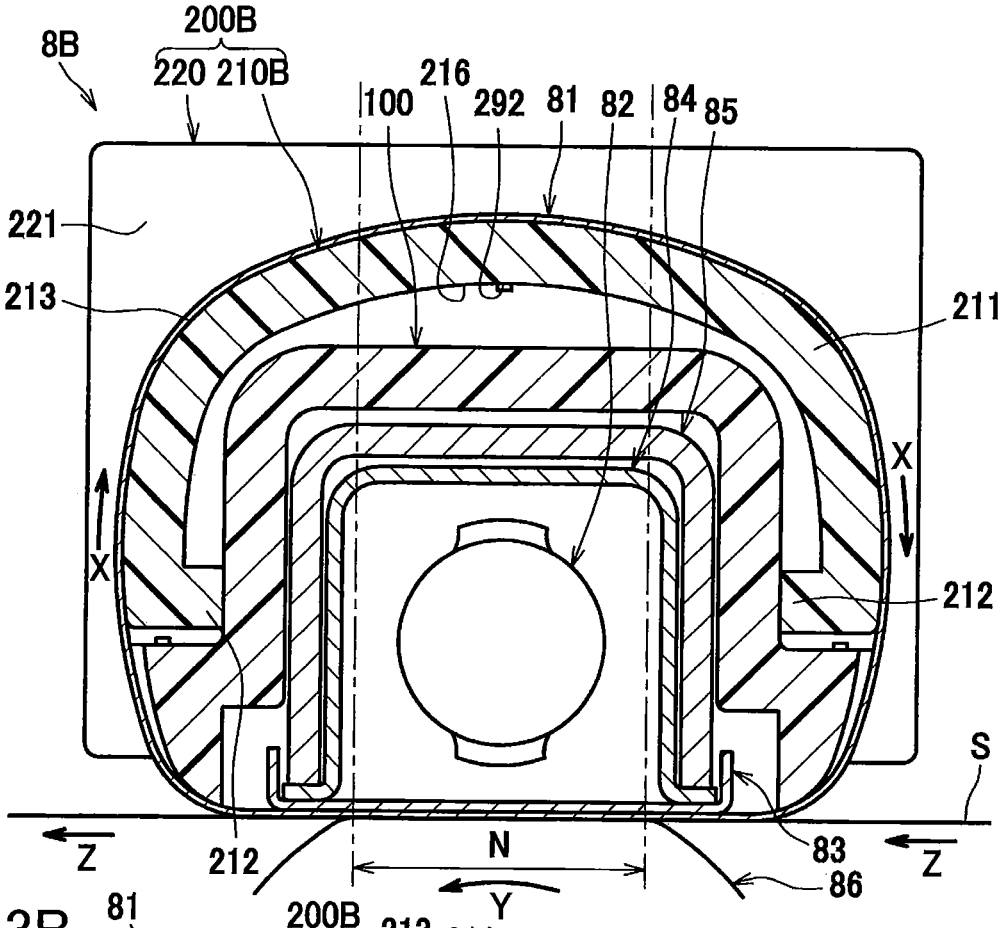
FIG. 13A is a cross-sectional side view of a fixing device according to a third embodiment.
Figure 13B:
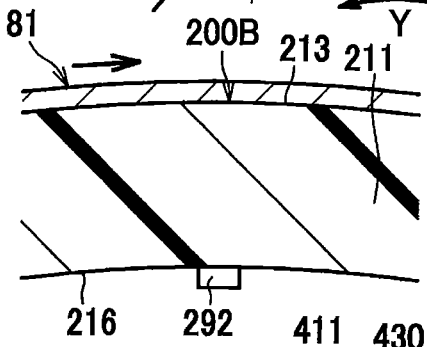
FIG. 13B is a partially-enlarged cross-sectional view of an area near a gate mark on an end guide member according to the third embodiment.

Next, a third embodiment will be described with reference to FIGS. 13A to 13C. As shown in FIGS. 13A and 13B, a fixing device 8B according to the third embodiment includes end guide members 200B each including an inner guide portion 210 and the restricting portion 220. Each inner guide portion 210 is provided with a gate mark 292. The gate mark 292 is disposed at a position corresponding to the guide surface 213 of each end guide member 200B (inner guide portion 210B) in the width direction. Specifically, the gate mark 292 is disposed on an underside surface 216 of each inner guide portion 210B, the underside surface 216 being opposite the guide surface 213. More specifically, the gate mark 292 is disposed at a center region on the underside surface 216 in the belt-moving direction X at the guide surface 213.

Here, the center region on the underside surface 216 in the belt-moving direction X at the guide surface 213 denotes a region on the underside surface 216 between the two extended end portions 212 in the belt-moving direction X at the guide surface 213. More specifically, assuming a nip region N at which the pressure roller 86 contacts the pressure roller 86, preferably, the gate mark 292 is provided in a region overlapping with the nip region N in the sheet-conveying direction Z when viewed in an upward direction from the nip region N toward the nip member 83. More specifically, the gate mark 292 is preferably provided in a range defined between two phantom lines shown in FIG. 13A. The gate mark 292 is a substantially columnar-shaped protrusion that protrudes downward from the underside surface 216.

Figure 13C:
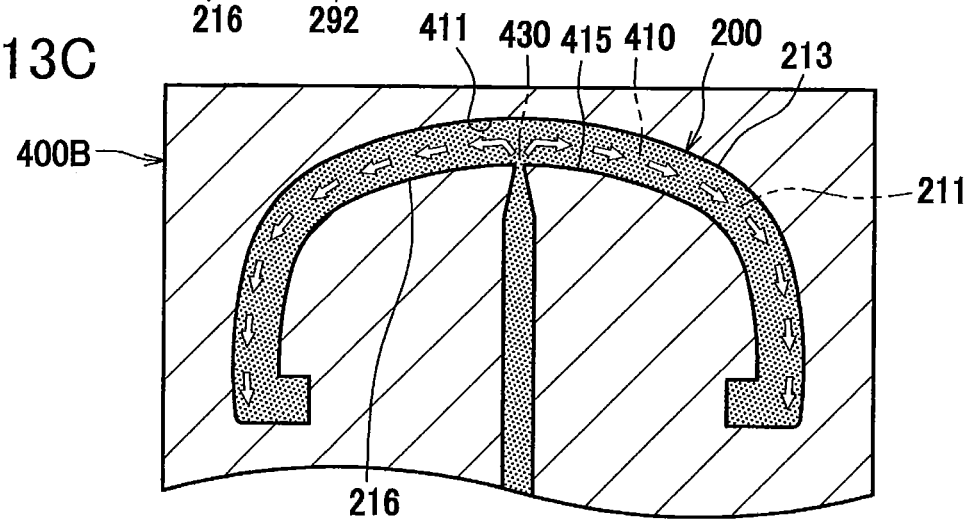
FIG. 13C is an explanatory view illustrating a structure of a mold for molding the end guide member according to the third embodiment and explaining a method of manufacturing the end guide member according to the third embodiment.

As shown in FIG. 13C, in a mold 400B for molding the end guide member 200B, an underside molding surface 415 defining a part of the cavity 410 functions to mold the underside surface 216. A gate 430 is provided at the underside molding surface 415. The gate 430 is disposed in a central portion on the underside molding surface 415 in the belt-moving direction X at the guide surface 213. The underside surface 216 is an example of a first surface, and the underside molding surface 415 is an example of a first molding surface.

Figure 7:
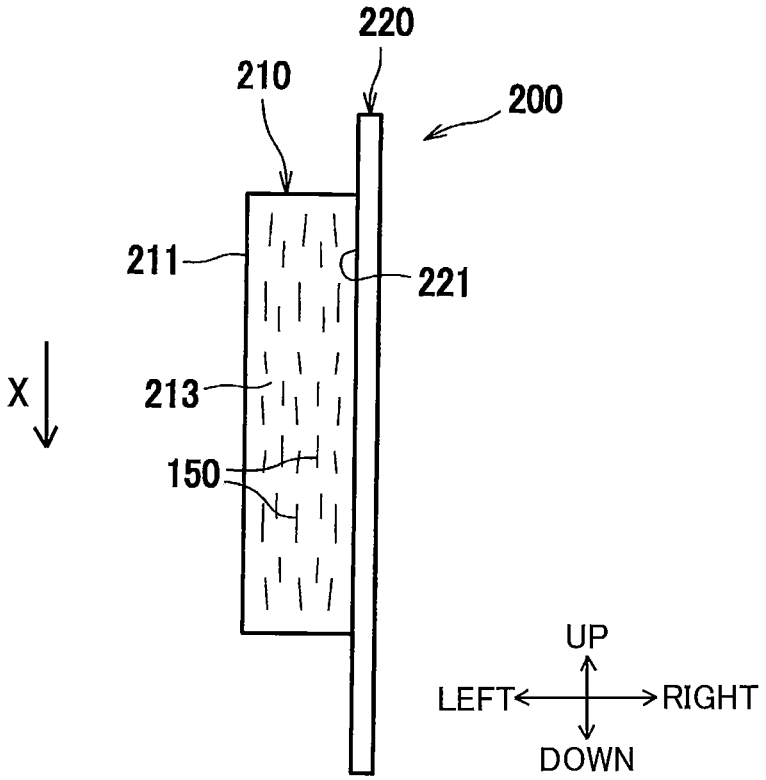
FIG. 7 is a front view of the end guide member disposed on the right according to the first embodiment.

When resin containing the fillers 150 is injected via the gate 430 into the mold 400 having this configuration, the injected resin diverges into two paths leading forward and rearward, as indicated by the arrows in FIG. 13C, and flows frontward and rearward along the guide-portion molding surface 411 and the underside molding surface 415, thereby forming the wall portion 211. Accordingly, the injected resin to mold the wall portion 211 can flow in the belt-moving direction X near the guide surface 213 of the wall portion 211, thereby enabling the longitudinal direction of most of the elongated-shaped fillers 150 dispersed in the injected resin to be aligned with the belt-moving direction X at the guide surface 213, as illustrated in FIG. 7.

While the gate marks 291 of the first embodiment and the gate mark 292 of the third embodiment are respectively generally columnar in shape, the gate marks may be formed in shapes different from the columnar shape. For example, the gate marks may have a shape elongated in the width direction.

4. Fourth Embodiment

Figure 14A:
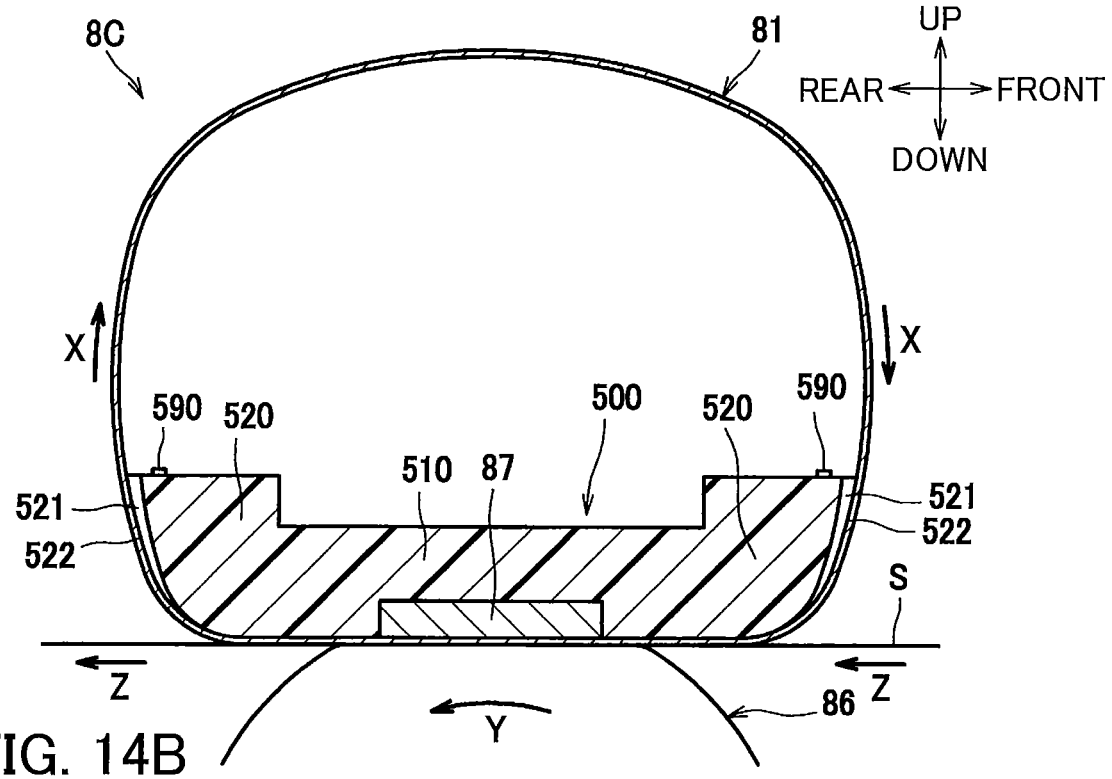
FIG. 14A is a cross-sectional side view of a fixing device according to a fourth embodiment.
Figure 14B:
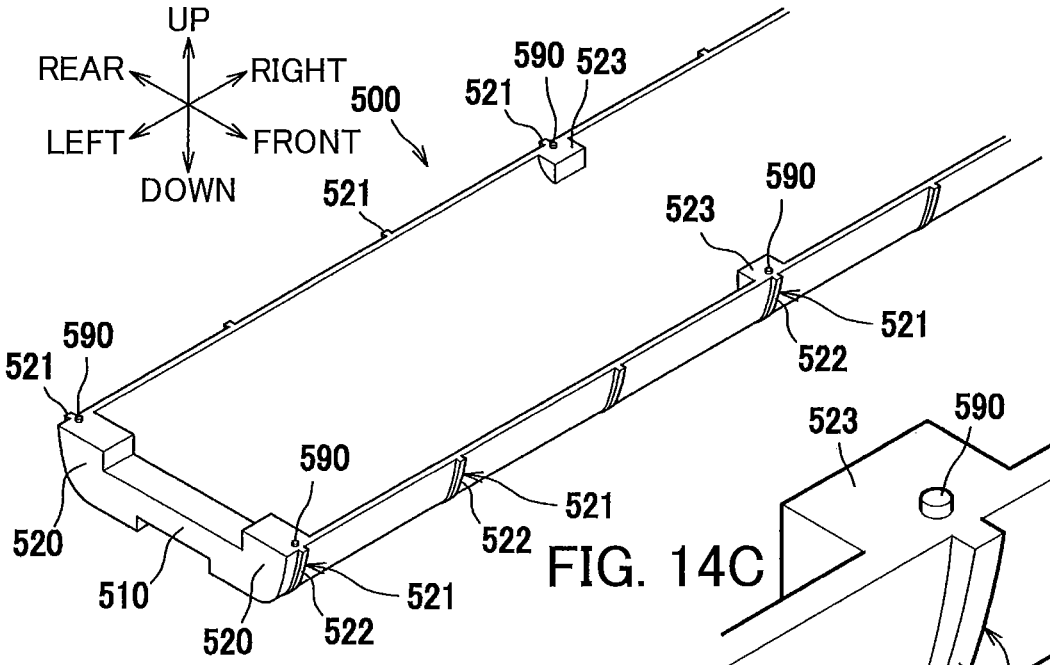
FIG. 14B is a perspective view of a guide member according to the fourth embodiment.
Figure 14C:
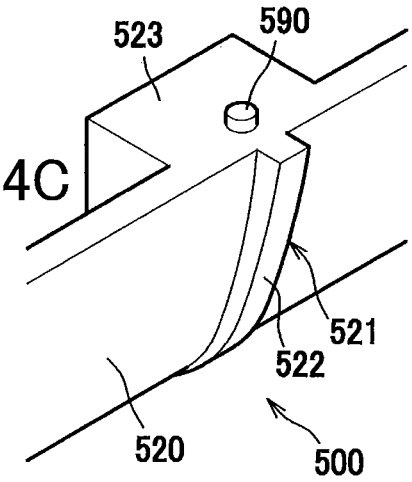
FIG. 14C is a partially-enlarged perspective view showing an area near a rightmost rib of the guide member according to the fourth embodiment.

Next, a fourth embodiment will be described with reference to FIGS. 14A to 14C. As shown in FIG. 14A, a fixing device 8C according to the fourth embodiment primarily includes the endless belt 81, the pressure roller 86, a ceramic heater 87, and a guide member 500.

The ceramic heater 87 is disposed in the inner space defined by the endless belt 81 such that the ceramic heater 87 is in contact with the inner peripheral surface of the endless belt 81. The ceramic heater 87 functions as a heater configured to radiate heat when powered, thereby heating the endless belt 81 to heat the toner carried on the sheets S.

The pressure roller 86 is disposed beneath the ceramic heater 87 such that the endless belt 81 is interposed between the pressure roller 86 and the ceramic heater 87.

The guide member 500 supports the ceramic heater 87 and is configured to guide the inner peripheral surface of the endless belt 81. The guide member 500 is elongated in the width direction. The guide member 500 primarily includes a heater-retaining portion 510 for holding the ceramic heater 87, and a pair of guide portions 520. The guide portions 520 are provided one at a position frontward of the heater-retaining portion 510, and the other one at a position rearward of the heater-retaining portion 510.

Each guide portion 520 has an outer peripheral surface on which a plurality of ribs 521 is arrayed at intervals in the width direction. Each rib 521 has a guide surface 522 configured to contact the inner peripheral surface of the endless belt 81 for guiding the endless belt 81.

The guide member 500 is formed of a resin material containing elongated-shaped fillers, such as glass fibers. As shown in FIGS. 14B and 14C, the guide member 500 includes a plurality of gate marks 590. The plurality of gate marks 590 is formed on each of top surfaces 523 of the front and rear guide portions 520. The gate marks 590 are arranged to be spaced apart from each other in the width direction. The gate marks 590 are disposed at positions corresponding to the ribs 521 in the width direction. In the present embodiment, each guide portions 520 is formed to have a greater thickness (dimension) in the front-rear direction in portions where the gate marks 590 are provided than in other portions without the gate marks 590. Accordingly, the thickness of the top surfaces 523 in the front-rear direction is greater in those regions where the gate marks 590 are provided than in other regions without the gate marks 590.

When molding the guide member 500, the resin material is injected into gates provided at positions corresponding to the gate marks 590. The injected resin can flow in the belt-moving direction X in areas near the guide surfaces 522. Accordingly, the fillers contained in the injected resin can be longitudinally oriented in the belt-moving direction X at the guide surfaces 522. Further, since the thickness of the top surfaces 523 is larger in regions where the gate marks 590 are provided than in other regions without the gate marks 590, gates of a larger size can be employed to facilitate the molding process for the guide member 500.

5. Variations and Modifications

While the disclosure is described in detail with reference to the specific embodiments thereof while referring to accompanying drawings, it would be apparent to those skilled in the art that many modifications and variations may be made therein without departing from the scope of the disclosure.

For example, in the first and second embodiments described above, the gate marks 190 of the guide member 100 and the gate marks 194 of the guide member 100A are disposed on the top surfaces 143 of the guide portions 140. However, the present invention is not limited to this arrangement. For example, in the example shown in FIG. 2A, gate marks for the guide member 100 may be formed on a top surface or a bottom surface of the top wall 110.

Further, in the depicted embodiments, the wall portion 211 of each end guide member 200 (200B) is arcuate shaped in conformance with the guide surface 213 when viewed in the width direction. However, an entirety of the wall portion need not have an arcuate shape. The wall portion may have a shape that generally conforms to the guide surface, for example. Alternatively, the wall portion may have a portion that has a stepped-like shape when viewed in the width direction.

In the embodiments described above, the guide member 100 (100A) and end guide members 200 (200B) are formed of a resin material containing the elongated-shaped fillers 150, such as long glass fibers. However, the resin used to form the guide member and end guide members may contain not only such elongated fillers but also non-elongated fillers, such as fillers having a general spherical shape.

While the endless belt 81 in the embodiments has a two-layered structure configured of the base layer 81A and the release layer 81B, the disclosure is not limited to this structure. For example, the endless belt may have a three-layered structure in which an elastic layer, such as a rubber layer is interposed between the base layer and release layer. Alternatively, the endless belt may be configured of four or more layers. Further, the base layer 81A of the depicted embodiment is made of a resin, such as polyimide resin, but the base layer may be formed of metal such as stainless steel, for example.

In the above embodiments, the laser printer 1 configured to form monochromatic images on the sheets S is employed as an example of the image-forming apparatus of the present disclosure. However, the image-forming apparatus of the disclosure may be a printer configured to form colored images on the sheets. Further, the image-forming apparatus of the disclosure may not only be applied to printers, but also to a copier and a multifunction device provided with an image-reading device such as a flat head scanner, for example.

What is claimed is:

1. An end guide incorporated in a fixing device including an endless belt configured to circularly move in a moving direction, the endless belt being elongated in a longitudinal direction orthogonal to the moving direction, the endless belt having an end portion in the longitudinal direction, the end guide comprising:

a guide portion having a length in the longitudinal direction that is shorter than a length of the endless belt in the longitudinal direction, the guide portion including a resin and a plurality of elongated-shaped fillers dispersed in the resin, the guide portion comprising:

a guide surface configured to guide movement of the endless belt in the moving direction, the end portion of the endless belt having an inner peripheral surface configured to contact the guide surface;

an opposite surface opposite the guide surface, the opposite surface having a center portion positioned center in the moving direction;

a downstream endface positioned at a downstream side relative to the guide surface in the moving direction, the downstream endface facing downstream in the moving direction; and an upstream endface positioned at an upstream side relative to the guide surface in the moving direction, the upstream endface facing upstream in the moving direction; and a gate mark protruding from at least one of the center portion of the opposite surface, the upstream endface, and the downstream endface.

2. The end guide according to claim 1, wherein the gate mark protrudes from the center portion of the opposite surface.

3. The end guide according to claim 2, wherein the opposite surface has an arcuate-shape when viewed in longitudinal direction, the arcuate-shape of the opposite surface defining an internal space therein, and wherein the gate mark is disposed inside the internal space defined by the arcuate-shape of the opposite surface.

4. The end guide according to claim 1, wherein the gate mark protrudes from the upstream endface.

5. The end guide according to claim 1, wherein the gate mark protrudes from the downstream endface.

6. A method of manufacturing the end guide according to claim 1, the method comprising:

preparing a mold having a cavity and a gate, the cavity having a shape in conformance with a shape of the guide portion, the mold including:

a first molding surface for molding the center portion of the opposite surface;

a second molding surface for molding the upstream endface; and a third molding surface for molding the downstream endface, the gate being provided at one of the first molding surface, the second molding surface and the third molding surface; and injecting a resin containing a plurality of elongated-shaped fillers into the cavity through the gate.

7. The method according to claim 6, wherein the gate is provided at the first molding surface of the mold.

8. The method according to claim 7, wherein the mold includes a guide molding surface for molding the guide surface, the guide molding surface having an arcuate-shape when viewed in longitudinal direction, the arcuate-shape defining an apex, and wherein, in the injecting, the resin is injected through the gate in a direction toward the apex defined by the arcuate-shape of the guide surface.

9. The method according to claim 6, wherein the gate is provided at the second molding surface of the mold.

10. The method according to claim 6, wherein the gate is provided at the third molding surface of the mold.

11. An end guide incorporated in a fixing device including an endless belt configured to circularly move in a moving direction, the endless belt being elongated in a longitudinal direction orthogonal to the moving direction, the endless belt having an end portion in the longitudinal direction, the end guide comprising:

a guide portion having a length in the longitudinal direction that is shorter than a length of the endless belt in the longitudinal direction, the guide portion including a resin and a plurality of elongated-shaped fillers dispersed in the resin, the guide portion comprising:

a guide surface configured to guide movement of the endless belt in the moving direction, the end portion of the endless belt having an inner peripheral surface configured to contact the guide surface;

an opposite surface opposite the guide surface;

a downstream endface positioned at a downstream side relative to the guide surface in the moving direction, the downstream endface facing downstream in the moving direction; and an upstream endface positioned at an upstream side relative to the guide surface in the moving direction, the upstream endface facing upstream in the moving direction; and a gate mark protruding from at least one of the opposite surface, the upstream endface, and the downstream endface.

12. The end guide according to claim 11, wherein the gate mark protrudes from the opposite surface.

13. The end guide according to claim 12, wherein the opposite surface has an arcuate-shape when viewed in longitudinal direction, the arcuate-shape of the opposite surface defining an internal space therein, and wherein the gate mark is disposed inside the internal space defined by the arcuate-shape of the opposite surface.

14. The end guide according to claim 11, wherein the gate mark protrudes from the upstream endface.

15. The end guide according to claim 11, wherein the gate mark protrudes from the downstream endface.

* * * * *